US006551192B1

(12) United States Patent
Rieber et al.

(10) Patent No.: US 6,551,192 B1
(45) Date of Patent: Apr. 22, 2003

(54) OBSTACLE ASSEMBLY FOR BIKES, SKATEBOARDS AND ROLLERBLADES

(75) Inventors: Frederick M. Rieber, Alum Bank, PA (US); Frank Bork, Bedford, PA (US)

(73) Assignee: Hedstrom Corporation, Bedford, PA (US)

( * ) Notice: Subject to any disclaimer, the term of this patent is extended or adjusted under 35 U.S.C. 154(b) by 0 days.

(21) Appl. No.: 10/157,637

(22) Filed: May 29, 2002

Related U.S. Application Data

(63) Continuation-in-part of application No. 10/059,510, filed on Jan. 29, 2002, now abandoned.

(51) Int. Cl.[7] ..... A63J 9/00

(52) U.S. Cl. ..... 472/88; 472/88; 472/89; 472/90; 256/1

(58) Field of Search ..... 472/88, 89, 90, 472/91; 256/1; 14/69.5, 71.1

(56) References Cited

U.S. PATENT DOCUMENTS 4,697,294 A * 10/1987 Schafer ..... 14/69.5
5,033,146 A * 7/1991 Fogarty et al. ..... 14/69.5
5,267,367 A * 12/1993 Wegmann, Jr. ..... 14/69.5
5,341,533 A 8/1994 Seitz
5,483,715 A * 1/1996 Fogarty et al. ..... 14/69.5
5,599,235 A 2/1997 Lynberg
D390,621 S 2/1998 Cosentino
5,718,412 A * 2/1998 Levanas ..... 256/1
5,946,756 A 9/1999 Mapp

* cited by examiner

*Primary Examiner*—Kien T. Nguyen
(74) *Attorney, Agent, or Firm*—Cesari and McKenna, LLP

(57) ABSTRACT

Obstacle apparatus includes at least one ramp for launching a bicycle, skateboard or rollerblade rider into the air. The apparatus may also include a second similar ramp and a bridge for releasably connecting the elevated ends of the two ramps in-line so as to produce an in-line obstacle over which riders may roll. The apparatus may also include a grind rail which may be releasably attached to the elevated end of one or both of the ramps so that the ramp/rail assembly may be used by skateboarders and the like to perform various acrobatic feats. The apparatus components are rugged and reliable yet they can be made in quantity at minimum cost. Furthermore, because of their unique designs, they may be shipped and stored in a minimum amount of space.

45 Claims, 6 Drawing Sheets

OBSTACLE ASSEMBLY FOR BIKES, SKATEBOARDS AND ROLLERBLADES

RELATED APPLICATION

This application is a continuation-in-part of Ser. No. 10/059,510, filed Jan. 29, 2002, now abandoned.

BACKGROUND OF THE INVENTION

This invention relates to obstacle apparatus for use by bikers, skateboarders and rollerbladers. It relates especially to obstacle assemblies incorporating launch ramps, grind rails and the like.

Various devices are in widespread use today to enable bikers, skateboarders and rollerbladers to perform various acrobatic and aerial feats. Among the most prevalent of these are the ramp which launches these individuals into the air and the elevated grind rail along which they may roll before dropping back to the ground. These different devices are usually separate stand-alone items that are not assembled in any particular way. Therefore taken together, these prior devices are large and unwieldy. Moreover, they are not portable and they take up a relatively large amount of shipping and storage space.

Also, most prior obstacle devices of this general type can only be used in one way to perform one specific function, e.g. as a launch ramp or a grind rail. It would be desirable therefore, to be able to provide a single assembly that can be used in a variety of different ways to achieve different objectives.

SUMMARY OF THE INVENTION

Accordingly it is an object of the present invention to provide an obstacle assembly for skateboarders, rollerbladers and bikers which can be organized in different ways to achieve a variety of different objectives.

Another object of the invention is to provide an assembly of this type, which, in its disassembled form, occupies a minimum amount of space.

A further object of the invention is to provide such an obstacle assembly whose components can readily be assembled without any special tools.

Still another object of the invention is to provide components for an obstacle assembly which are rugged and reliable yet can be manufactured in quantity at minimum cost.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the assembly incorporating the invention comprises at least one ramp for launching a bicycle, skateboard or rollerblade rider into the air. The assembly may also include a second similar ramp and a bridge or bridging member for releasably connecting the elevated ends of the two ramps in-line so as to produce an in-line obstacle over which riders may roll. The assembly may also include a grind rail which may be releasably attached to the elevated end of one or both of the ramps so that the ramp/rail assembly may be used by skateboarders to perform various acrobatic feats. As we shall see, the components of the assembly are rugged and reliably yet they can be made in quantity at minimum cost. Furthermore, because of their unique designs, they may be shipped and stored in a minimum amount of space.

BRIEF DESCRIPTION OF THE DRAWINGS

For a fuller understanding of the nature and objects of the invention, reference should be made to the following detailed description taken in connection with the accompanied drawings, in which.

DESCRIPTION OF THE PREFERRED EMBODIMENTS

Figure 1:
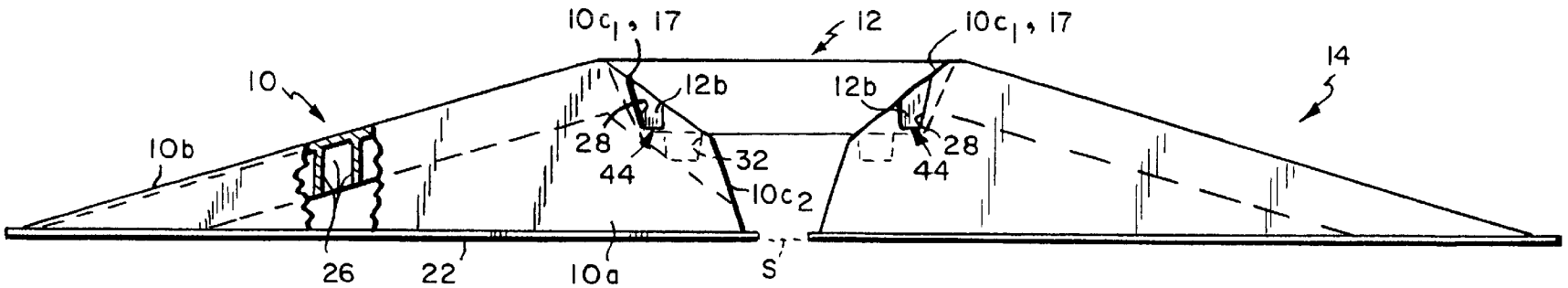
FIG. 1 is a side elevational view with parts broken away showing obstacle apparatus according to the invention organized as an in-line ramp/bridge assembly.

Refer to FIG. 1 of the drawings which shows an inclined ramp indicated generally at 10. The upper end of ramp 10 may be connected by a bridge or bridging member 12 to the upper end of a similar, but backward facing, ramp 14 to form an assembly constituting an in-line obstacle which may be traversed by bikers, skateboarders and rollerbladers. The assembly preferably also includes a grind rail shown generally at 16 in FIG. 2, one end of which may be connected to the elevated end of one of the ramps, e.g. ramp 10, to add variety to the overall obstacle assembly. Since ramps 10 and 14 are substantially identical, we will only describe ramp 10 in detail.

Figure 3A:
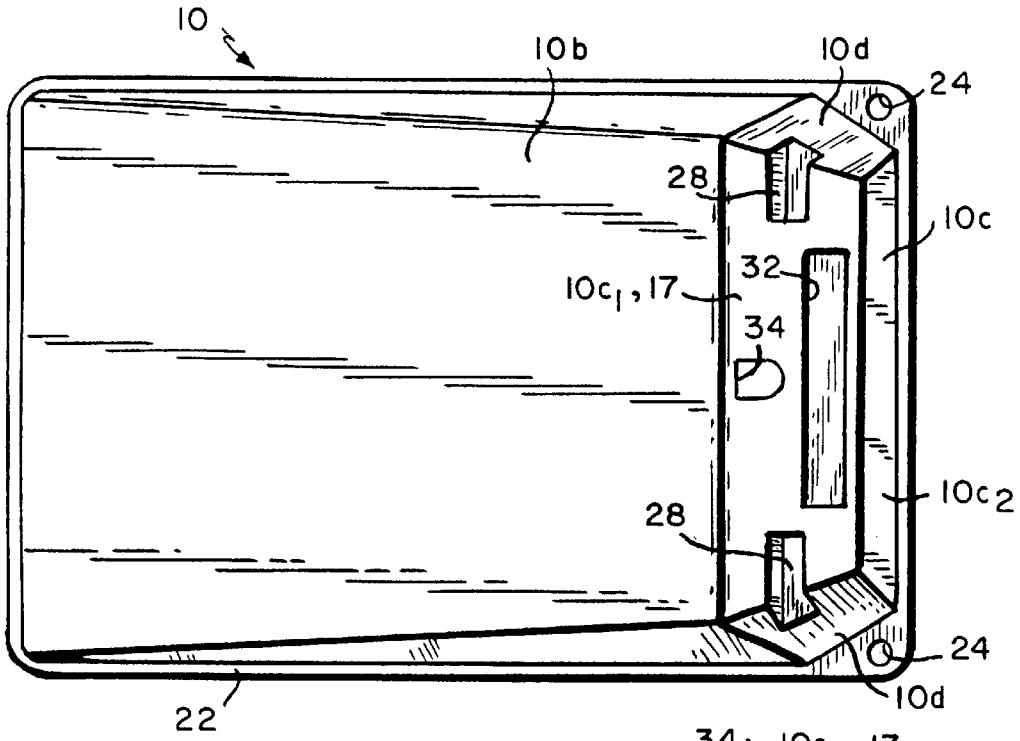
FIG. 3A is a top plan view of the ramp component of the FIGS. 1 and 2 assembly.
Figure 3B:
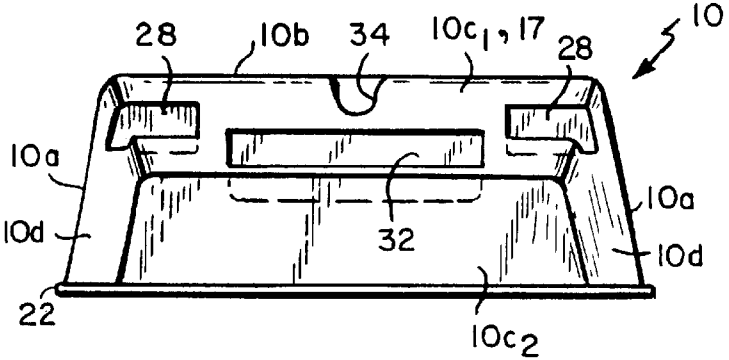
FIG. 3B is a front elevational view thereof.
Figure 3C:
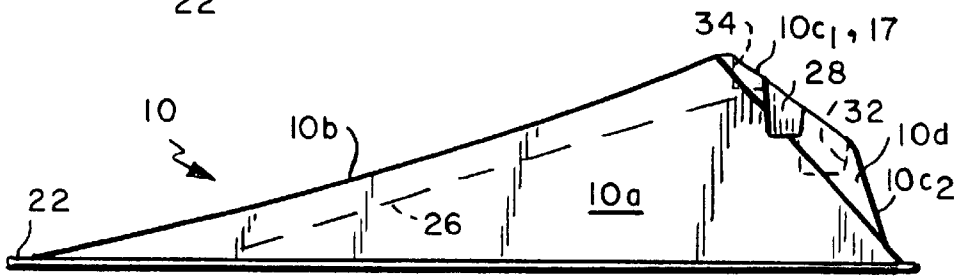
FIG. 3C is a side elevational view with parts broken away thereof.

Referring to FIGS. 3A to 3C, ramp 10 is a generally rectangular molded plastic is structure including a pair of mirror-image, generally triangular side walls 10*a*, 10*a* having upper edges connected by a generally rectangular top wall 10*b* and rear edges connected by a faceted rear wall 10*c*. More particularly, rear wall 10*c* has an upper facet or surface $\mathbf{10}c_1$ which descends from the apexes of side walls 10*a*, 10*a* at an angle of about 45° to form a ledge 17 and a lower facet or surface $\mathbf{10}c_2$ which extends at a steeper angle from facet $\mathbf{10}c_1$ to the lower edges of side walls 10*a*, 10*a*. As best seen in FIG. 3A, facet $\mathbf{10}c_1$ has a generally trapezoidal shape, while facet $\mathbf{10}c_2$ is more or less rectangular with a length corresponding more or less to the smaller length of facet $\mathbf{10}c_1$. Also, the ramp side walls 10*a*, 10*a* are splayed out to some extent adjacent to the rear end of the ramp. Resultantly, as viewed from above, the rear corners of the ramp are beveled as shown at 10*d*, 10*d*.

As best seen in FIGS. 1 and 3A a flange 22 extends out from the ramp side and rear walls, including bevels 10*d,* 10*d,* as well as from the lower or leading edge of the ramp top wall 10*b.* In other words, the flange extends all around the perimeter of the ramp at the lowermost edges thereof providing co-planar surface areas which are adapted to engage a support surface S (FIG. 1), usually the ground or pavement so that the ramp top wall 10*b* is oriented at a selected angle relative to surface S and so that the leading edge of the top wall is located very close to that surface as shown in FIG. 1. Through holes 24 may be provided in flange 22 at the corners for hanging the ramp from a wall hook or the like.

Referring to FIGS. 1 and 3C, in order to rigidify ramp 10, the ramp may be formed with a multiplicity of integral stiffening ribs 26 which extend down from the top wall 10*b* and the rear wall 10*c* of the ramp. These ribs are arranged in a rectangular grid which extends between the ramp side walls 10*a,* 10*a* and between the ramp rear wall 10*c* and the leading edge of top wall 10*b.*

For reasons that will become apparent, a plurality of transverse pockets or depressions are formed in the rear wall facet $\mathbf{10}c_1$, i.e. ledge 17. More particularly, a pair of relatively short, generally rectangular pockets 28, 28 are provided at the opposite ends of ledge 17 adjacent to the upper edge thereof. Pockets 28 extend in a line that is parallel to the upper edge of the ledge. Preferably for reasons that will become apparent, these pockets have a wedge-shaped or tapered cross-section. In other words, the open tops or mouths of these pockets are larger than the bottoms thereof. Located just below pockets 28, 28 in ledge 17 is a transverse rectangular pocket or depression 32 which is longer and deeper than pockets 28. Centered just above pocket 32 in ledge 17 is a small generally semi-cylindrical pocket 34 aligned with the longitudinal centerline or axis of ramp 10. Pockets 32 and 34 are used in to secure the grind rail 16 to the ramp as will be described in more detail later. Pocket 32 may also function as a carrying handle for ramp 10.

The launch ramp 10 depicted in FIGS. 3A to 3C constitutes a rugged weather resistant ramp structure which, when placed on support surface S enables a skateboarder, rollerblader or biker to propel himself up the ramp with a velocity such that the rider will be launched into the air as he leaves the elevated rear end of the ramp. Preferably, the ramp top wall 10*a,* in profile, has a slight concave curvature to optimize the lifting effect of the ramp.

Figure 4A:
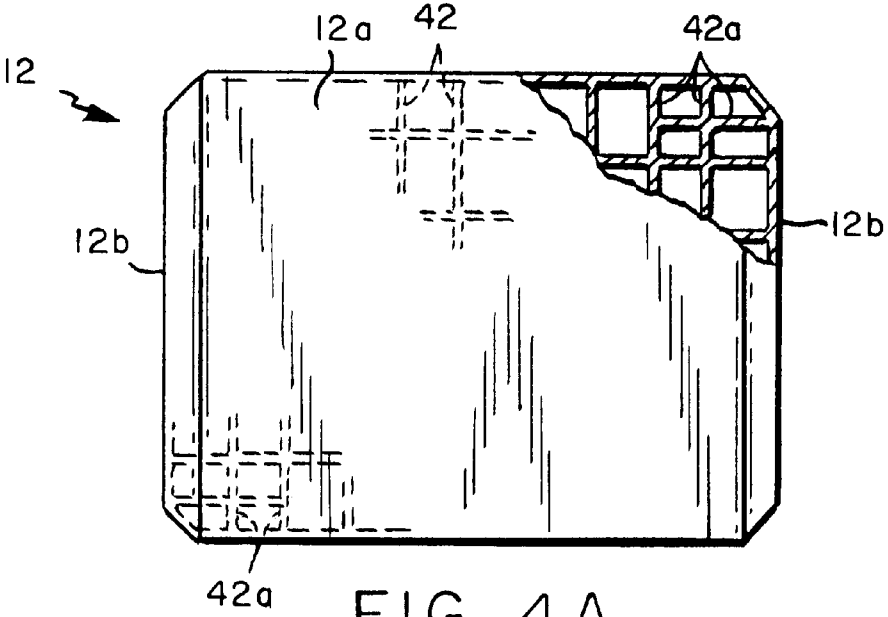
FIG. 4A is a top plan view of the bridge component of the FIG. 1 assembly.
Figure 4B:
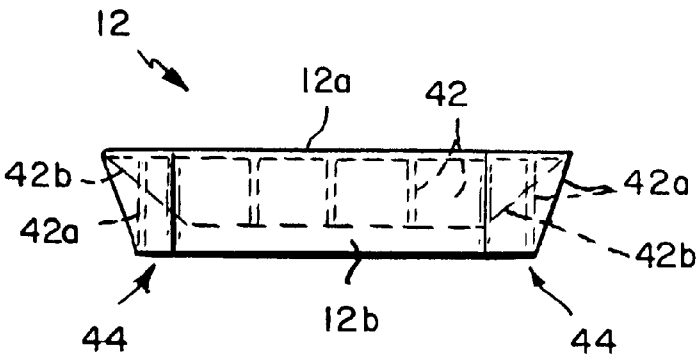
FIG. 4B is a side elevational view thereof.
Figure 4C:
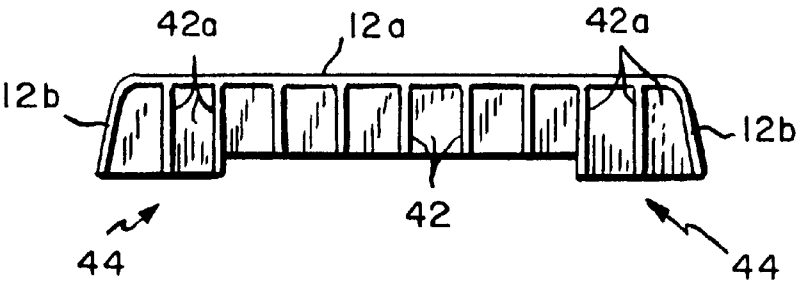
FIG. 4C is a front elevational view thereof.

Refer now to FIGS. 4A to 4C which show in detail the bridge 12 which is connected between the two ramps 10, 14 arranged back to back as shown in FIG. 1. Bridge 12 is also a molded plastic structure having a generally rectangular top wall 12*a* and a pair of mirror image side walls 12*b,* 12*b* extending down from the top wall. Preferably bridge 12 has no front and rear walls per se. However, it does have a multiplicity of integral stiffening ribs 42 extending down from top wall 12*a* to form a rectangular grid which extends between side walls 12*b,* 12*b* and in between the front and rear edges of top wall 12*a.* Moreover, at the front and rear edges of bridge 12 at the opposite ends thereof, these ribs are shaped and dimensioned to form locking tabs shown generally at 44 which are adapted to plug into the sockets 28 of ramps 10 and 14.

More particularly, as best seen in FIG. 4C, the side walls 12*b,* 12*b* of bridge 12 and opposite end segments 42*a* of the two front-to-back ribs 42 that are closest to each side wall 12*b* extend below the remainders of ribs 42. Moreover as shown in FIG. 4B, the ends of those opposite end segments 42*a* are beveled at a shallower angle than the ends 42*b* of the other front-to-back ribs 42, those other rib ends 42*b* having the same bevel angle as that of ledge 17 of the ramp 10 shown in FIG. 3C. Thus, at the four corners of bridge 12, the ends of the rib segments 42*a* combine to form the four locking tabs 44 which are shaped and dimensioned to plug into the pockets 28 of ramps 10, 14, the taper of tabs 44 corresponding to that of the pockets.

When bridge 12 is seated on the ledges 17, 17 of ramps 10 and 14 as shown in FIG. 1, it is securely locked in place so that skateboarders, rollerbladers and the like can ride up one ramp 10, travel across bridge 12, and ride down the other ramp 14 with little likelihood of the components of that assembly coming apart due to vibration, impacts and the like. The undersides of the ramp flanges 22 may be coated with a non-slip material such as rubber, plastic or the like to minimize unwanted sliding motion of the assembly components relative to a support surface S such as pavement.

As noted above, the assembly may also be organized to include a grind rail 16 which may accessed by a rider riding up one of the ramps 10, 14 onto one end of the grind rail. Grind rail 16 may be of more or less conventional construction, the only requirement being that the end of the rail adjacent to the associated ramp 10, 14 be fitted with connector means shown generally at 50 adapted to plug into at least one of the pockets in ramp 10 such that the end of the grind rail is level with the upper end of the ramp top wall 10*b.*

Figure 2:
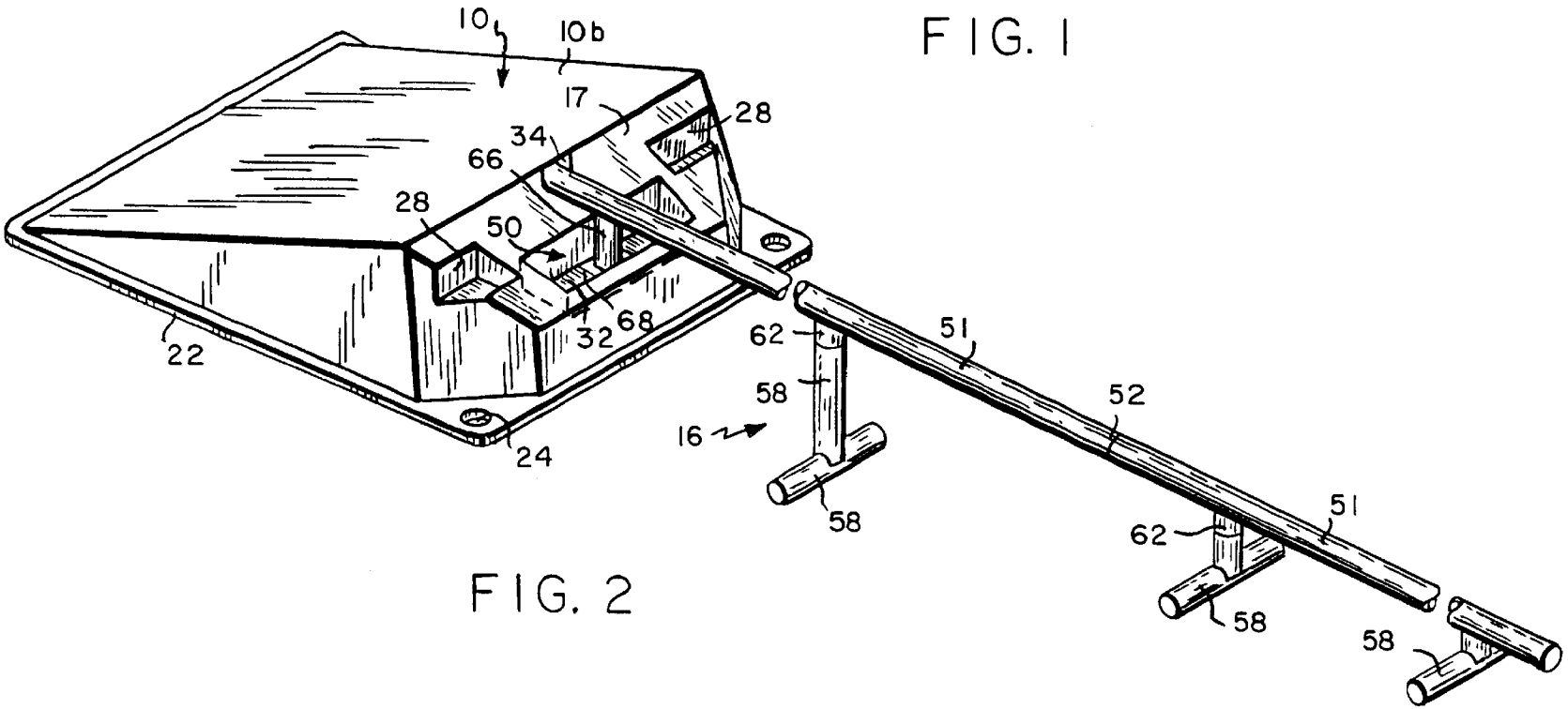
FIG. 2 is a right rear perspective view showing elements of the assembly forming a ramp-up grind rail.

While the grind rail 16 may take different forms, the one illustrated in FIG. 2 is preferred. It includes an elongated tubular rail 51 composed of tube sections 51*a* and 51*b* which may be connected together by suitable means at a joint 52. The connection may be a telescoping connection, a collinear collar secured to the abutting ends of the rail sections or most preferably, the connection described in co-pending application Ser. No. 09/991,811, filed Nov. 23, 2001, the contents which is hereby incorporated herein by reference.

The illustrated connector means 50 is designed to plug into the pockets 32 and 34 of a ramp 10, 14. The rail 16 may be supported above the ground along its length by inverted T-shaped supports 58 whose legs may plug into sockets 62 welded or otherwise secured to the undersides of rail sections 51*a,* 51*b.* The supports 58 may have different heights so that rail 51 is inclined as shown in FIG. 2. Alternatively, the supports may all have the same height as the associate ramp 10, 14 in which case rail 51 will be supported horizontally. In a further variation, a connector means 50 may be provided at both ends is of rail 16 and the rail suspended between the two ramps 10, 14 in the same manner as bridge 12. In that event, the supports 58 may not be needed, depending upon the length of rail 51.

As shown in FIG. 2, connector means 50 include a short leg 66 having one end connected to rail section 51*a* at a location therealong spaced a short distance from the free end of section 51*a* such that the leg is perpendicular to the rail section. The above connection may be permanent, i.e. a weld, or it may be a releasable socket-type connection described above. Secured to the opposite end of leg 66 is a foot 68 which extends out laterally on opposite sides of leg 66 and rail section 51*a.*

The free end of rail section 51*a* is adapted to seat in the pocket 34 of ramp 10, while the foot 68 seats in the ramp pocket 32 such that the end of rail section 51 is level with the upper edge of ramp top wall 10*b;* see FIG. 2. Thus, the assembly provides a smooth transition from ramp to rail. The engagement of the wide foot 68 in pocket 32 prevents rotation of rail 16 and maintains the alignment of the ramp and rail.

Figure 5:
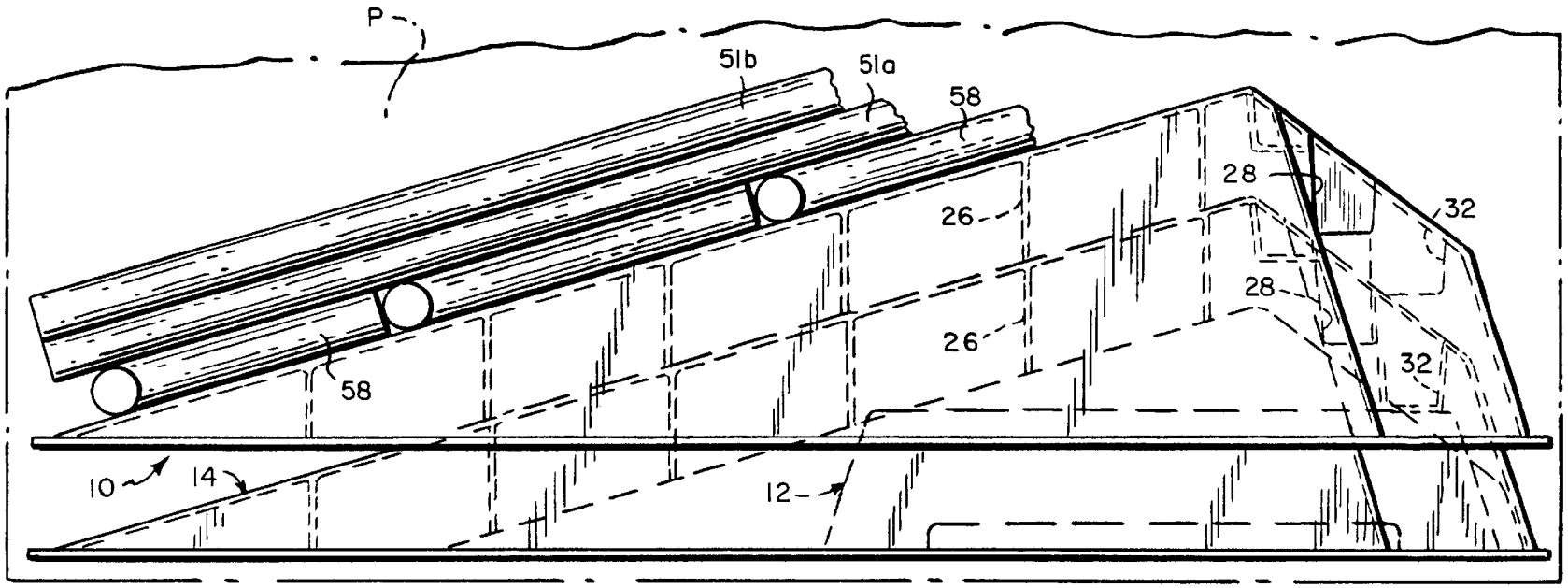
FIG. 5 is a side elevational view on a larger scale showing the components of the FIGS. 1 and 2 assembly stacked for shipping and storage.

Refer now to FIG. 5 which illustrates how all of the components of the assembly are shaped and arranged so that they may be shipped and stored as a minimum size package P. More particularly, bridge 12 is dimensioned and tapered so that, when inverted, it can nest within the underside of a ramp 10, 14 as shown. In particular, the bevel angle of the ends of the bridge rib segments 42*a* correspond to the angle of the ramp top wall 10*b* and ledge 17, and the height of the bridge corresponds to the distance between the ramp flange 22 and the bottom of the ramp pocket 32. Also, the fact that each ramp 10, 14 has tapered side and rear walls enables each ramp to be nested within the other ramp such that the top wall 10*b* and ledge 17 of the lower ramp nest against the undersides of the ramp ribs 26 and the pockets 28 of the upper ramp. Once the ramp and bridge components of the assembly are nested as shown in FIG. 5, the parts of the grind rail 16 may be positioned on the top wall 10*b* of the upper ramp, fitting easily within the package P. Alternatively, the grind rail 16 may be sold separately from package P.

Certain changes may be made in the above construction without departing from the scope of the invention. For example, the ramps 10, 14 may be solid bodies and/or made wider than the bridge 12 and the pockets 32, 34 placed to one side of ledge 17 allowing both the bridge 12 and grind rail 16 to be suspended side by side between ramps 12 and 14. This gives riders the option of using either the bridge or the grind rail.

Figure 6:
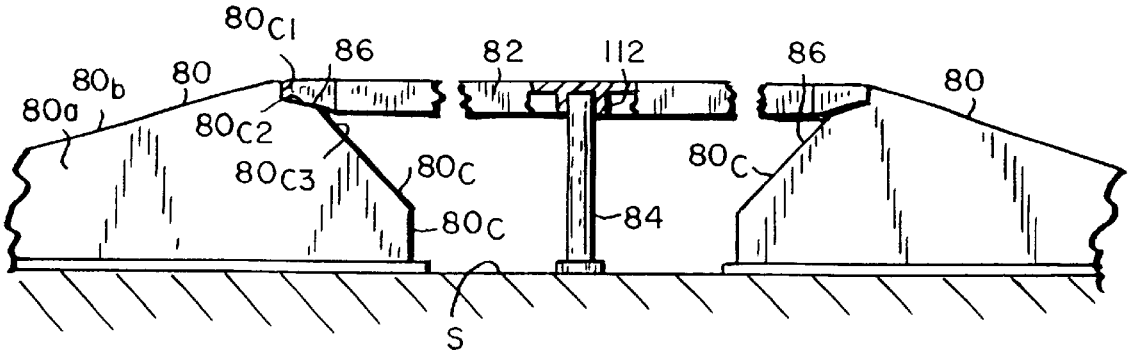
FIG. 6 is a view similar to FIG. 1 showing a second embodiment of the obstacle assembly.
Figure 7:
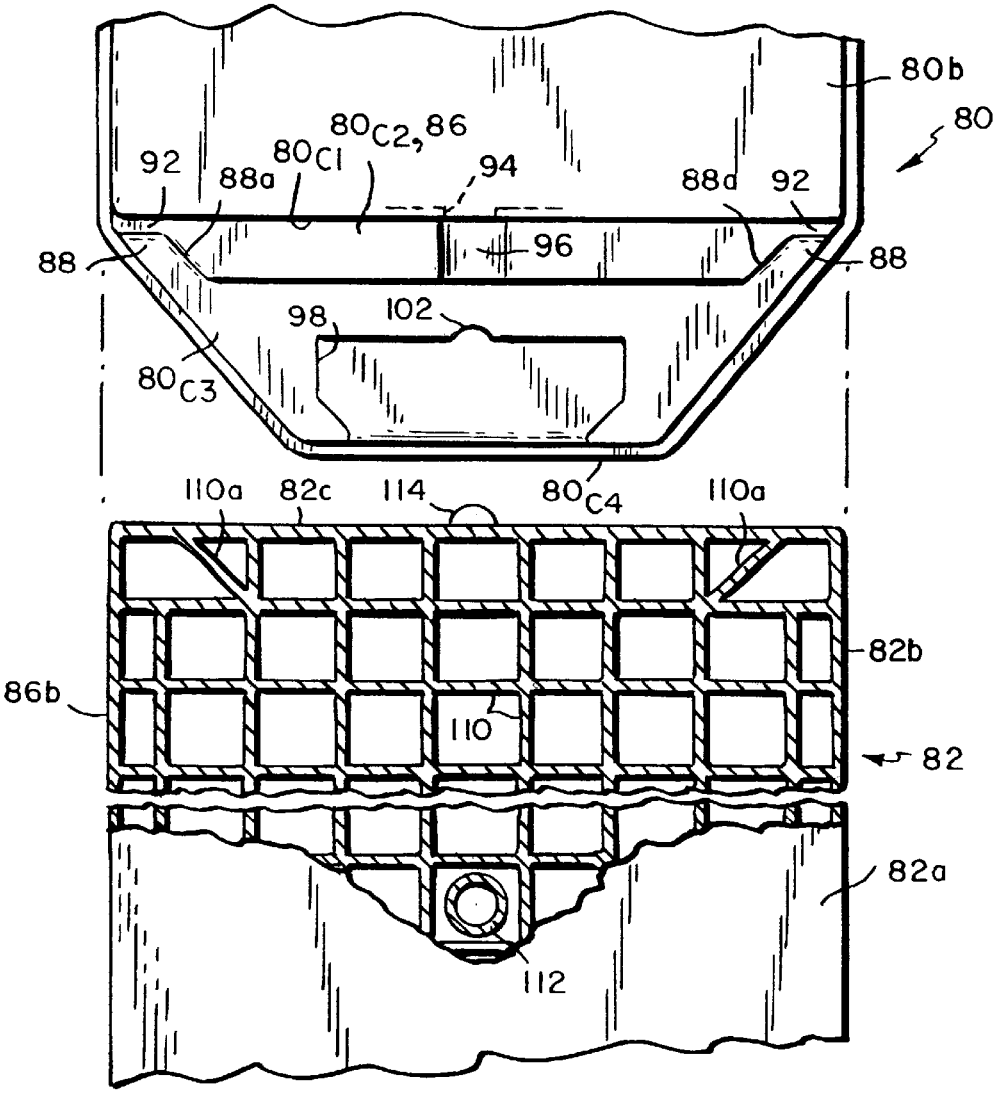
FIG. 7 is a fragmentary exploded view showing components of the FIG. 6 assembly in more detail.

Refer now to FIG. 6 which illustrates a second embodiment of our obstacle assembly employing a pair of ramps 80 spaced back-to-back and supporting the opposite ends of a bridge 82. Bridge 82 may be of indeterminate length and may be supported at its mid-point by a vertical post 84 releasably connected at its upper end to the bridge, the opposite end of the post extending down to the same surface S that supports the ramps 80. Like ramp 10, each ramp 80 has a pair of opposite, generally triangular side walls 80*a*, an inclined top wall 80*b* and a faceted rear wall 80*c* composed of a vertical upper facet or portion $\mathbf{80}c_1$, a more or less horizontal facet $\mathbf{80}c_2$ defining a ledge 86 leading to a steeply inclined middle facet or portion $\mathbf{80}c_3$ defining a ledge 86 and a vertical lower facet $\mathbf{80}c_4$. As best seen in FIG. 7, facets $\mathbf{80}c_2$ and $\mathbf{80}c_3$ define a generally trapezoidal shape, while facets $\mathbf{80}c_1$ and $\mathbf{80}c_4$ are more or less rectangular with lengths corresponding more or less to the larger and smaller collective lengths of facets $\mathbf{80}c_2$, $\mathbf{80}c_3$, respectively. Each ramp 80 has a bottom flange and stiffening ribs similar to the ones described above in connection with ramps 10, 14.

As best seen in FIG. 7, a pair of dove tail humps 88 extend up from ledge 86 in spaced relation to the rear wall facet $\mathbf{80}c_1$ leaving a locking gap 92 between each hump and the facet $\mathbf{80}c_1$. Moreover, the inboard wall 88*a* of each hump 88 is oriented at an angle of about ±45° with respect to the longitudinal axis of the ramp and facet $\mathbf{80}c_1$ for reasons that will become apparent. Still further, a notch 94 is formed in the rear wall facet $\mathbf{80}c_1$ at the longitudinal axis of the ramp and a semi-cylindrical depression 96 extends from notch 94 rearwardly along ledge 86.

Also for reasons that will become apparent, a pronounced lateral pocket or depression 98 is formed in facet $\mathbf{80}_{c3}$ adjacent the lower edge thereof and a vertical groove 102 is present in the forward wall of pocket 98 opposite the end of groove 96. Pocket 98 is adapted to receive the foot 68 of leg 66 that supports the upper end of the grind rail 16 shown in FIG. 2, with the groove 102 providing clearance for leg 66 and a securing pin (not shown) if that leg is releasably connected to the grind rail by way of a socket 62 (FIG. 2).

Still referring to FIG. 7, bridge 82 is similar to bridge 12 in that it is a molded plastic structure having a generally rectilinear top wall 82*a*, a pair of opposite side walls 82*b*. Bridge 82 is different in that it is provided with opposite end walls 82*c*. A rectilinear array of ribs 110 extends down from top wall 82*a* between the side and end walls.

Preferably, a depending socket 112 is formed in the middle of bridge 82 for releasably receiving the upper end of the post 84 as shown in FIG. 6.

In order to releasably secure each end of bridge 82 to the adjacent ramp 80, a tab 114 projects out from the center of each end wall 82*c* of the bridge, only one such tab 114 being shown in the drawings. When attaching bridge 82 to ramps 80, each tab 114 is adapted to snap into the notch 94 of the adjacent ramp 80 as will be described shortly.

Also as best seen in FIG. 7, the bridge end walls 82*c* and ribs 11O are configured to facilitate the attachment of bridge 82 to each ramp 80. More particularly, each end wall 82*c* of the bridge is adapted to seat in the gaps 92 adjacent each ramp hump 88 and the bridge rib structure includes special diagonal ribs 110*a* adjacent the corners of bridge 82 which are oriented at an angle slightly less than 45° with respect to the longitudinal axis of the bridge so that when the end wall 82*c* of bridge 82 is engaged to the adjacent ramp 80, the diagonal ribs 110*a* engage the walls or surfaces 88*a* of humps 88 as shown in FIG. 8B. Resultantly, due to the misalignment of walls 88*a* and ribs 110*a*, the ribs 110*a* are flexed to some extent so that the end of each bridge 82 resiliently engages the adjacent ramps so that there is no play between the bridge and the ramps when they are pressed together as will be described presently. Since the parts of the obstacle assembly are spring loaded by hump 88/ribs 110*a* when engaged, there is minimal play between these parts so that they function as a single unit. Resultantly, there is no creaking or shattering noise when bikers or skate-boarders ride up and over the assembly.

When ramps 80 and bridge 82 are separated from one another, they may be nested one within the other in the manner shown in FIG. 5 so that they can be packaged, shipped and stored in a minimum amount of space.

Figure 8A:
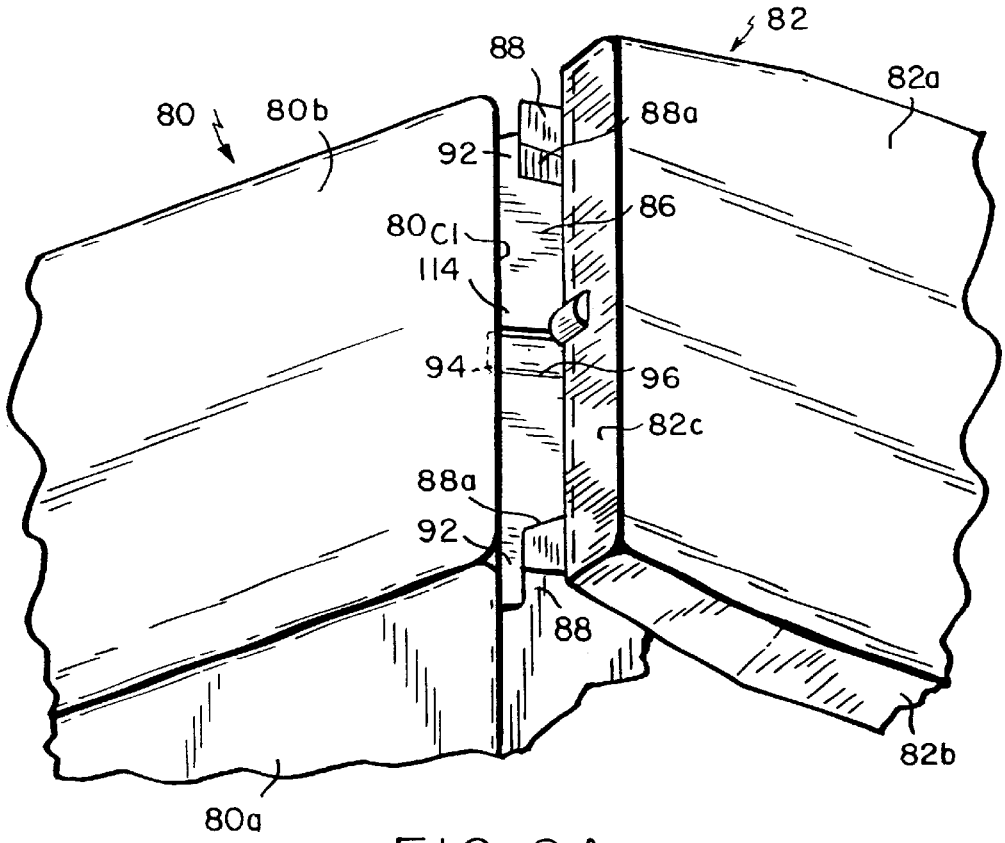
FIGS. 8A and 8B are fragmentary perspective views illustrating the mode of connecting the components of the FIG. 6 assembly.
Figure 8B:
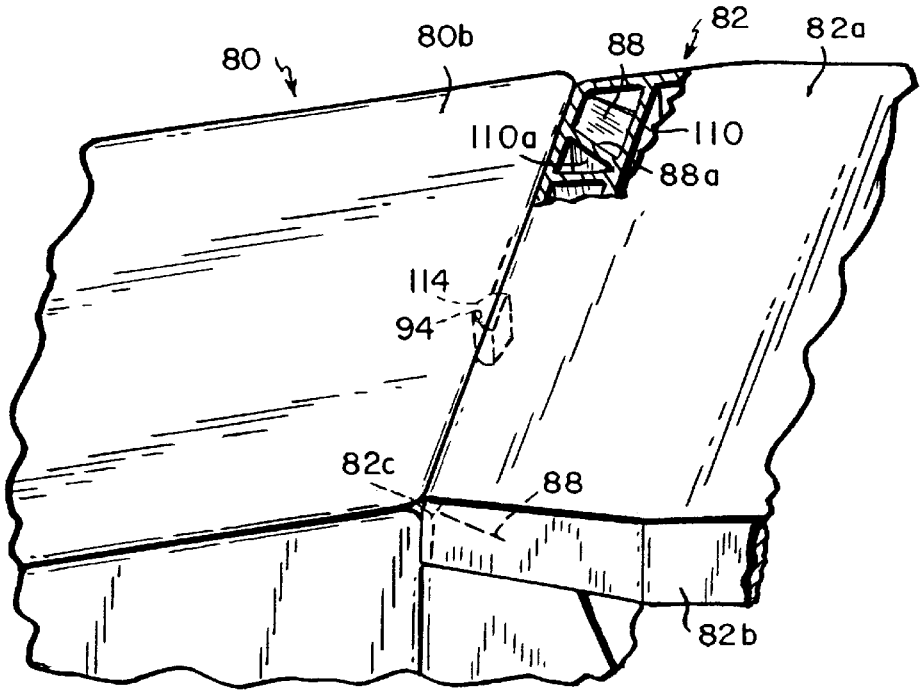

Referring now to FIGS. 8A and 8B, in order to connect an end of bridge 82 to the adjacent ramp 80, the bridge is tilted with respect to the ramp as shown in FIG. 8A so that the bridge end wall 82*c* can be engaged or hooked in the locking gaps 92 in front of the raised humps 88 and then the bridge 82 is lifted up so that it is substantially horizontal as shown in FIG. 8B. With wall 82*c* being retained by the humps 88, this motion causes the tab 114 projecting from the bridge end wall 82*c* to resiliently engage the rear wall facet $\mathbf{80}c_1$ of the opposing ramp 80, perhaps deflecting that facet and/or end wall 82*c* in the process, until tab 114 reaches the notch 94 in facet $\mathbf{80}c_1$. When the tab is moved opposite the notch, the tab snaps into the notch thereby locking that end of bridge 82 to the adjacent ramp 80, while the end of the bridge is resiliently seated against the ramp humps as described above. As the tab snaps into place in the notch, an audible clicking sound is emitted which signals that the bridge is locked to the ramp. The depression 96 in rear wall 80*c* provides clearance for tab 114.

Because the ramp and bridge components are spring loaded when locked together as aforesaid, there is essentially no play between the assembled components and the components function as a unit as long as the locking tab 114 of the bridge is engaged in the notch 94 of the ramp.

When the bridge 82 is connected at both ends to ramps 80, 80 as shown in FIG. 6 and the post 84 is installed in the bridge socket 112 as shown there, the assembly will function as a unit allowing bikers, skate boarders, rollerbladers and the like to ride up one ramp 80 along bridge 82 and down the other ramp 80. Due to their unique mode of attachment, the components will not become separated even if there is appreciable vibration of the parts while the assembly is in use.

When it becomes necessary to separate the bridge from the ramps, this may be done by tilting the ramps downward with respect to the bridge with enough force to cause tabs 114 to deflect the corresponding ramp facets $\mathbf{80}c_1$ inward until the tabs are released from their respective notches thereby allowing the ends of the ramps to separate due to their spring loaded assembly.

It will thus been seen that the objects set forth above among those made apparent from the preceding description are efficiently attained. Also, the invention apparatus may include obvious variations. For example, the bridge 82 may have corners configured to connect to an additional pair of back-to-back ramps 80 extending from the sides of the bridge forming two orthogonal paths over bridge 82 along which riders may travel in criss-cross fashion. Therefore, it is intended that all matter contained in the above description or shown in the accompanying drawings shall be interpreted as illustrative and not in a limiting sense.

It is also to be understood that the following claims are intended to cover all of the scribed herein.

We claim:

1. Obstacle apparatus comprising a ramp body having a front end;

a rear end there being a longitudinal axis extending between said ends;

an inclined top wall with front and rear edges and opposite side edges;

a pair of side walls extending down from the side edges of the top wall to a horizontal plane that forms an acute angle with the top wall at the front end of the ramp body;

a rear wall at the rear end of the ramp body, said rear wall extending from the rear edge of the top wall down to said plane so as to define a ledge, and means at said rear wall for interfitting with a bridge supported on said ledge.

2. The apparatus defined in claim 1 and further including a multiplicity of ribs extending from said inclined top wall toward said plane, said ribs including a first set of ribs extending between said side walls and a second set of ribs extending between said rear wall and the front edge of the ramp body, said first and second sets of ribs being joined in a rectangular grid.

3. The apparatus defined in claim 2 and further including a flange extending out from at least some of said side and rear walls in said plane.

4. The apparatus defined in claim 3 and further including means defining holes in said flange.

5. The apparatus defined in claim 1 wherein the interfitting means include at least one pocket in said rear wall, each pocket extending toward said plane.

6. The apparatus defined in claim 5 wherein said ledge has a pair of in-line pockets located on opposite sides of said axis.

7. The apparatus defined in claim 5 wherein said ledge has a relatively long transverse pocket centered on said axis and at least one shorter pocket between the long pocket and the rear edge of the top wall.

8. The apparatus defined in claim 7 wherein the ledge has a pair of shorter in-line pockets on opposite sides of said axis.

9. The apparatus defined in claim 7 wherein the ledge has a shorter pocket aligned with said axis.

10. The apparatus defined in claim 5 and further including a second ramp body similar to the first-mentioned ramp body, said ramp bodies being positioned with their rear walls in spaced opposition, and a generally rectangular bridging member extending between, and seated on, the ledges of said ramp bodies, said bridging member having a pair of side walls and a top wall extending between said side walls in the same plane defined by the top wall rear edges of said ramp bodies, and a plurality of projections extending in a direction away from said top wall of the bridging member, said projections engaging in selected ones of said pockets to secure the bridging member to said ramp bodies.

11. The apparatus defined in claim 10 wherein the bridging member has a first set of ribs depending from the top wall thereof and extending between the side walls of the bridging member, and a second set of ribs depending from the top wall of the bridging member and extending orthogonal to the first set of ribs, said first and second sets of ribs being joined in a rectangular grid.

12. The apparatus defined in claim 11 wherein the projections are located at the four corners of the bridging member adjacent to the side walls thereof.

13. The apparatus defined in claim 12 wherein the projections are each constituted by opposite end segments of the second set of ribs, which end segments extend further from said top wall than the remainders of said ribs.

14. The apparatus defined in claim 5 wherein the ramp body has a rear wall portion extending down from the rear edge of the top wall to the ledge, and a pair of humps extend up from the ledge on opposite sides of said axis, said humps being spaced apart from the rear wall portion so as to define a pair of locking gaps therebetween.

15. The apparatus defined in claim 14 and further including a locking notch in the rear wall portion of the ramp body between said humps.

16. The apparatus defined in claim 14 wherein the pair of humps have opposing walls which are oriented at selected angles relative to said rear wall portion.

17. The apparatus defined in claim 16 wherein said selected angles are about ±45°.

18. The apparatus defined in claim 14 and further including a locking notch in the rear wall portion of the ramp body.

19. The apparatus defined in claim 18 wherein the first end of the grind rail seats in a second pocket in the ledge of the ramp body.

20. The apparatus defined in claim 18 wherein the support means comprise a second ramp body similar to the first-mentioned ramp body, the two ramp bodies being arranged with their rear walls in spaced opposition;

a second transverse foot adjacent to the second end of the grind rail, the second foot being arranged and adapted to engage in said at least one pocket in the second ramp body so that the second end of the grind rail is supported level with the top wall rear edge of the second ramp body.

21. The apparatus defined in claim 14 and further including a grind rail having first and second ends;

a transverse foot extending perpendicular to said rail adjacent to the first end thereof, said foot being arranged and adapted to engage in said at least one pocket in the ledge of said ramp body so as to support the first end of the grind rail or said ramp body level with the top wall rear edge thereof, and support means for supporting the second end of the grind rail.

22. Obstacle apparatus comprising a bridge having a generally rectangular top wall having front and rear edges and opposite side edges defining four corners;

a pair of parallel side walls depending from the opposite side edges of the top wall and having opposite end segments;

a first set of spaced-apart ribs depending from said top wall and extending between the side walls;

a second set of parallel ribs depending from the top wall and extending perpendicular to the first set of ribs, said first and second sets of ribs being joined in a grid;

means including said ribs at said corners for securing the bridge to a pair of ramps, said opposite end segments of the side walls and those ribs of the second set of ribs adjacent to said side walls extending below the remainders of the ribs to form securing means constituted by a set of four depending locking tabs.

23. Obstacle apparatus comprising a bridge having a generally rectangular top wall having front and rear edges and opposite side edges defining four corners;

a pair of parallel side walls depending from the opposite side edges of the top wall and having opposite end segments;

a first set of spaced-apart ribs depending from said top wall and extending between the side walls;

a second set of parallel ribs depending from the top wall and extending perpendicular to the first set of ribs, said first and second sets of ribs being joined in a grid;

means including said ribs at said corners for securing the bridge to a pair of ramps, and said opposite end segments of the side walls and those ribs of the second set of ribs adjacent to said side walls extending below the remainders of the ribs to form securing means constituted by a set of four depending locking tabs.

24. Obstacle apparatus comprising an elongated rail having first and second ends;

a leg having opposite ends, one of which is secured to the rail at a located thereon spaced a short distance from the first end thereof so that the leg extends substantially perpendicular to the rail;

a transverse foot mounted to the other end of the leg, said foot extending out appreciably on opposite sides of the rail;

first support means for supporting said foot at a elevated location, and second support means for supporting the second end of the rail.

25. The apparatus defined in claim 24 wherein the first support means comprise a ramp having an upper end and a lower end, and means at the upper end of said ramp for securing said foot to said ramp.

26. The obstacle apparatus defined in claim 24 wherein the second support means include one or more telescopically adjustable legs extending perpendicular to the rail and being terminated by an elongated foot extending out appreciably on opposite sides of the rail.

27. Obstacle apparatus comprising an inclined top wall having front and rear edges and opposite side edges;

a pair of opposite side walls extending from said side edges to a generally horizontal plane that forms an acute angle with the top wall at the front edge thereof;

a rear wall extending from said rear edge to said plane, said rear wall having a plurality of facets including one facet that has a horizontal component so as to define a ledge for supporting a bridge, and interfitting means at said one facet for interfitting with a bridge supported by said ledge.

28. The apparatus defined in claim 27 wherein the intermitting means include a pair of humps projecting up from the one facet on opposite sides of said axis.

29. The apparatus defined in claim 28 and further including a pocket in said rear wall below said one facet.

30. The apparatus defined in claim 28 wherein said one facet is spaced below the rear edge of the top wall;

a substantially vertical rear wall facet extends between said rear edge of the top wall and said one facet;

said humps are spaced from said vertical facet, and a notch is present in said vertical facet.

31. The apparatus defined in claim 30 wherein said notch is located substantially on said axis.

32. The apparatus defined in claim 30 and further including a generally rectangular bridge having an upper wall and an end wall hooked over said pair of humps so that the end wall is disposed opposite said vertical rear wall facet and the upper wall is substantially level with said top wall rear edge.

33. The apparatus defined in claim 32 and further including a tab projecting from said end wall into said notch so as to releasably lock the bridge to said rear edge.

34. The apparatus defined in claim 32 further including a plurality of ribs depending from the upper wall of the bridge adjacent to the end wall thereof, selected ones of said ribs resiliently engaging said pair of humps when the bridge upper and end walls are hooked over said pair of humps.

35. The apparatus defined in claim 34 wherein said pair of humps have opposing surfaces oriented at selected angles relative to said vertical rear wall facet, and said selected ones of said ribs are oriented at angles slightly different from said selected angles.

36. The apparatus defined in claim 35 wherein said selected angles are about ±45°.

37. The apparatus defined in claim 28 wherein said humps have opposing walls which are oriented at selected angles relative to said axis.

38. The apparatus defined in claim 37 wherein said selected angles are about ±45°.

39. The apparatus defined in claim 27 wherein said rear wall includes a substantially vertical facet extending down from the rear edge of the top wall to said one facet;

said interfitting means include humps spaced from said vertical facet and projecting up from said one facet substantially to said rear edge;

another rear wall facet extends from the one facet down towards said plane, and a pocket is present in said another facet, said pocket being substantially centered on said axis.

40. Obstacle apparatus comprising a first ramp body having a front end, a rear end, an inclined top wall with front and rear edges and opposite side edges, a pair of opposite side walls extending down from the side edges of the top wall to a horizontal plane that forms an acute angle with the front wall at the front end of the ramp body and a rear wall at the rear end of the ramp body, said rear wall extending from the rear edge of the top wall down to said plane;

a second ramp body similar to the first ramp body, said first and second ramp bodies being positioned with their rear walls in spaced opposition;

a bridging member extending between the rear walls of the first and second ramp bodies, said bridging member having opposite first and second edges, and means for releasably connecting the first and second edges of the bridging member to the rear walls of the first and second ramp bodies, respectively, so that the top wall of the bridging member is spaced above said plane and even with the top wall rear edges of the first and second ramp bodies.

41. The obstacle apparatus defined in claim 40 wherein the means for releasably connecting include portions of the first and second edges interfitting with portions of the rear walls of the first and second ramp bodies, respectively.

42. Obstacle apparatus comprising a first ramp body having a front end, a rear end, an inclined top wall with front and rear edges and opposite side edges, a pair of opposite side walls extending down from the side edges of the top wall to a horizontal plane that forms an acute angle with the front wall at the front end of the ramp body and a rear wall at the rear end of the ramp body, said rear wall extending from the rear edge of the top wall down to said plane;

a grind rail having first and second ends and a longitudinal axis extending between said ends;

means for releasably securing the first end of the grind rail to the rear wall of the ramp body so that said first end is substantially even with the top wall rear edge of said body, and means for supporting the second end of the grind rail above said plane.

43. The obstacle apparatus defined in claim 42 wherein the securing means comprise intermitting portions of said first end of the grind rail and the rear wall of the ramp body.

44. The obstacle apparatus defined in claim 42 wherein the means for supporting comprise of one or more legs extending from said grind rail, each leg being terminated by a foot extending perpendicular to said axis in said plane.

45. The obstacle apparatus defined in claim 44 wherein each leg includes a pair of telescoping leg sections, and means for adjusting the relative lengthwise position of said leg sections.

* * * * *

UNITED STATES PATENT AND TRADEMARK OFFICE

CERTIFICATE OF CORRECTION

PATENT NO. : 6,551,192 B1
DATED : April 22, 2003
INVENTOR(S) : Frederick M. Rieber et al.

It is certified that error appears in the above-identified patent and that said Letters Patent is hereby corrected as shown below:

Column 12,
Line 16, change "intermitting" to -- interfitting --

Signed and Sealed this

Sixteenth Day of September, 2003

JAMES E. ROGAN
*Director of the United States Patent and Trademark Office*